United States Patent [19]

Waiser

[11] Patent Number: 4,577,429

[45] Date of Patent: Mar. 25, 1986

[54] FASTENING MEANS FOR A REMOVABLE REVOLVER CYLINDER

[76] Inventor: Shimon Waiser, P.O. Box 360, Midwood Station, Brooklyn, N.Y. 11230

[21] Appl. No.: 680,320

[22] Filed: Dec. 10, 1984

Related U.S. Application Data

[63] Continuation-in-part of Ser. No. 387,166, Jun. 10, 1982, abandoned.

[51] Int. Cl.[4] ..... F41C 1/00

[52] U.S. Cl. ..... 42/59

[58] Field of Search ..... 42/59, 62

[56] References Cited

U.S. PATENT DOCUMENTS

| | | | |
|---|---|---|---|
| 694,969 | 3/1902 | Kemp | 42/59 |
| 743,784 | 11/1903 | Wesson | 42/62 |
| 847,011 | 3/1907 | Kolb et al. | 42/62 |

*Primary Examiner*—Deborah L. Kyle
*Assistant Examiner*—John S. Maples

[57] ABSTRACT

A fastening means for securing a removable cylinder in a revolver comprising a displaceable member and a pushing means. The pushing means enters the cylinder bore and thereby urges the displaceable member into a hole in the frame to secure said cylinder.

4 Claims, 5 Drawing Figures

FASTENING MEANS FOR A REMOVABLE REVOLVER CYLINDER

This application is a continuation-in-part of Ser. No. 387,166 filed June 10, 1982, now abandoned.

This invention relates to firearms and it has reference more particularly to improvement in handguns.

Up to this time many different constructions of semi-automatic recoil-operated revolvers were designed. One of them was produced in England from 1901 until the end of the First World War. All those constructions were single-action revolvers of the recoil-operated type. With those revolvers it was impossible to repeat a shot with another cartridge after misfire by pushing a trigger again. Also those revolvers were not good designs for withstanding dirt.

These and other difficulties experienced with the prior art devices have been obviated in a novel manner by the present invention.

It is an object of the present invention to provide a double-action semi-automatic recoil-operated revolver.

Another object of the invention is to provide a semi-automatic recoil-operated revolver having a special opening in the rear part of the frame behind the cylinder through which a fired cartridge shell could get out from the cylinder after a shot.

It is a further object of the present invention to provide a semi-automatic recoil-operated revolver with a locking system located between cylinder and hammer to lock a cartridge during and immediately after a shot and to reduce a recoil force acting on the hammer.

It is an object of this invention to provide a revolver with rapid change of cylinders employing for this purpose fixing detent(s) placed on side(s) of the revolver.

Another object of the invention is to provide a revolver with rapid change of cylinders which can be loaded with cartridges of different types of both rimless cartridges and rimmed cartridges.

It is another object of the present invention to provide a revolver with a handle which contains a spare cylinder inside.

Another object of the present invention is to provide a semi-automatic revolver with mechanically programmable trigger block system without a disconnector at all having at least two sears one of which is a trigger release sear and the second one is a blocking sear located on the trigger.

It is another object of the invention to provide a revolver with an interlock blocking the revolver hammer in fully cocked position if the revolver cylinder is not in firing position.

Other objects and advantages of the present invention will be apparent from the accompanying description when considered in conjunction with the following drawings, in which.

Figure 1:
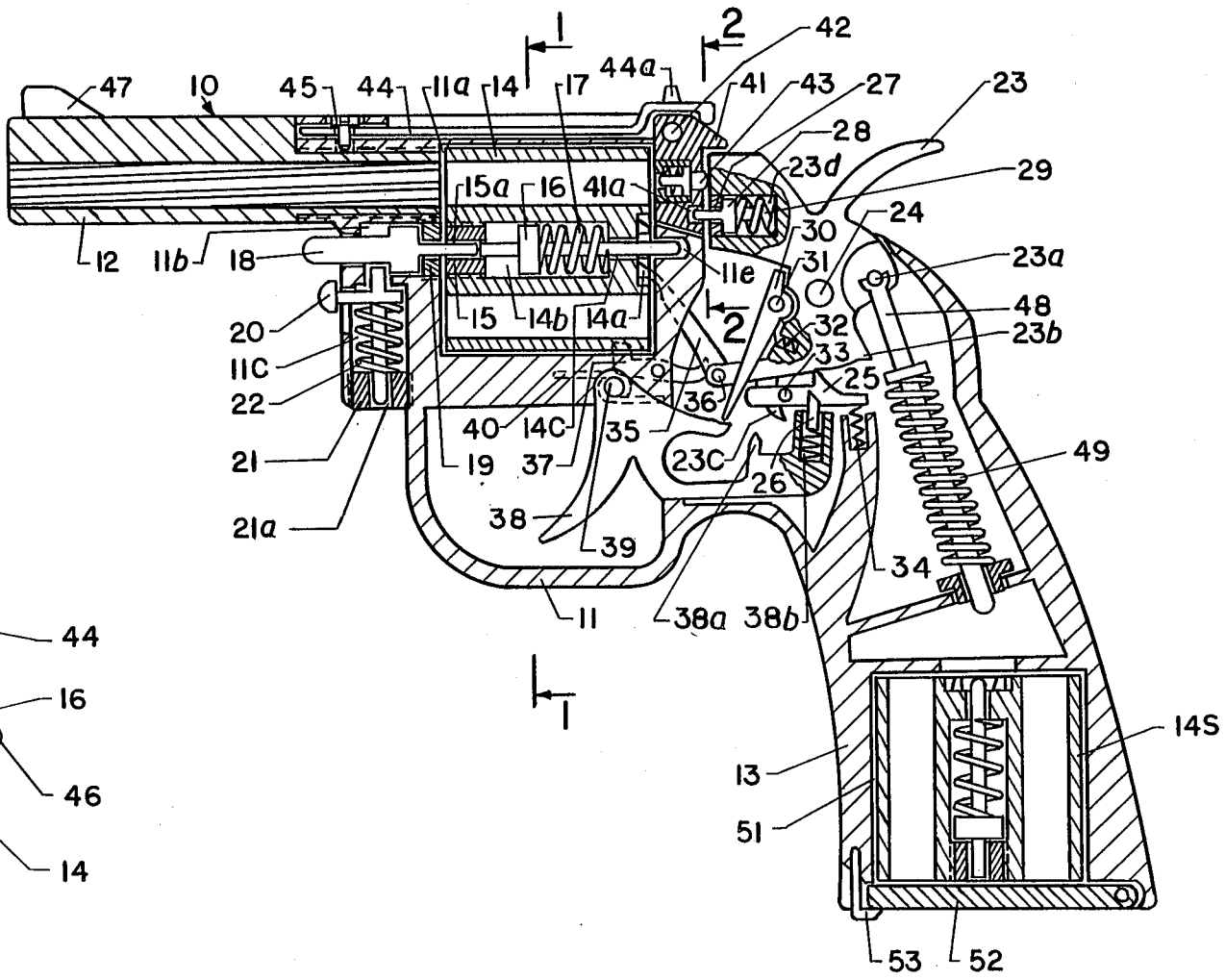
FIG. 1 is a longitudinal, sectional view of the gun according to the present invention in trigger-released position.
Figure 3:
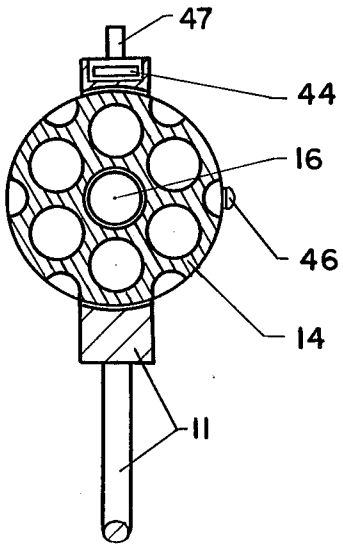
FIG. 3 is a sectional view along line I—I of FIG. 1.

Referring first to FIGS. 1,2,3 and 4, wherein are best shown the general features of the invention, the gun, indicated generally by the reference numeral 10, is shown as consisting of a frame structure 11, a barrel 12 and a handle 13.

The frame structure 11 comprises:

A cylinder recess 11*a* in which a cylinder 14 is removably and rotatably mounted. This cylinder 14 is equipped at its rear end with a ratchet gear 14*a* and has a bore 14*b* plugged from the front end with a plug 15 having an opening 15*a* in it. The bore 14*b* is connected with another bore 14*c* of the cylinder 14. In the bores 14*b*, 14*c* and 15*a* is located a spring loaded rod 16 having a flange that is under the action of a spring 17 and has a length at least approximately equal to a length of the cylinder.

A recess 11*b* in which a cylinder locking rod 18 is located and which is plugged from the rear by a plug 19 having a hole in it.

A recess 11*c* in which a spring loaded latch 20 is located and which is plugged from the bottom with a plug 21 having a hole 21*a* in it. This latch 20 exists for fixing the rod 18 and is under the action of spring 22.

A hammer 23, which is pivotally mounted on the frame structure 11 by a pivot pin 24 and having a stirrup pin 23*a* on it. A sear notch 23*b* is located on the hammer 23 and destined to be engaged by a main sear 25 when the hammer 23 is rotated to its firing cocked position and by an auxiliary sear 26 when the hammer 23 is rotated to its intermediate (maximum) cocked position. At the bottom of the hammer 23 there is a special tooth 23*c* which is one of components of an interlock blocking the hammer 23 in a firing position if the cylinder 14 is not in a firing position. A recess 23*d* is located in the upper part of the hammer 23 and is plugged with a plug 27 having a hole in it. In this recess 23*d* there is a spring loaded pin 28 being under the action of a spring 29. This pin 28 enters in a special recess 41*a* in a cartridge locking shutter 41 for the purpose of extending the time of influence of recoil force on this shutter 41 before it opens.

A hammer strut 30 which is pivotally mounted on the hammer 23 by a pivot pin 31 and is pressed by a spring 32.

The main sear 25 which is pivotally mounted on the frame structure 11 by a pivot pin 33 and is pressed to the surface of the hammer 23 by a spring 34.

A hand 35 which is for rotating the cylinder 14 when the hammer 23 is being cocked and this hand 35 is pivotally mounted on the hammer 23 by a pivot pin 36.

A cylinder latch 37 which is mounted on the frame structure 11 to engage releasably the cylinder 14 to prevent rotation thereof when the revolver is being fired. This cylinder latch 37 is simultaneously the second component of the interlock blocking the hammer 23 in a firing position engaging said tooth 23*c* on the bottom of the hammer 23 if the cylinder 14 is not in a firing position.

A trigger 38 which is pivotally mounted on the frame structure 11 by a pivot pin 39 and is pressed by a trigger spring 40 (shown by dotted line). On the rear part of this trigger 38 there are a main sear pushing projection 38*a* and a recess 38*b* in which is located the spring loaded auxiliary sear 26.

A recess 11*d* in which the cartridge locking shutter 41 is pivotally mounted on the frame structure 11 by a pivot pin 42. This shutter 41 has the small recess 41*a* in which the pin 28 enters. A spring loaded firing pin 43 is also located in this shutter 41.

A cartridge locking shutter spring 44 which is fastened to the frame structure 11 by a screw 45 and on which a rear sight 44*a* is located.

Two cylinder detents 46 which help to fix the cylinder 14 in the frame structure recess 11*a* with speed during reloading of the gun and which are positioned at a distance equal or a little greater than a radius of the cylinder from the axis of symmetry of the cylinder when the latter is in the working position in the recess 11*a* of the frame structure 11.

The barrel 12 having a front sight 47 on it is fastened to the frame structure 11 in the usual manner.

The handle 13 comprises:

A stirrup 48 which is under the action of a main spring 49.

A special recess 51 for storage of a spare cylinder 14*s* therein.

A pivotally mounted cover 52 to lock the spare cylinder 14*s* in the recess 51.

A spring-catch 53 to lock this cover 52.

Two grips 54 fastened to the handle 13 by two screws 55.

To fire at the first time it is necessary to pull the trigger 38 backwards. The trigger 38 will start to turn counter-clockwise around the pivot pin 39 and by its special projection located under the hammer strut 30 will press the hammer strut 30 turning thereby the hammer 23 clockwise. Simultaneously the hand 35 by its lower part turns the cylinder latch 37 counter-clockwise disengaging the latter with the cylinder 14. When moving further upwards the upper part of this hand 35 engages the ratchet gear 14*a* of the cylinder 14, thereby causing the cylinder 14 to rotate when the hammer 23 is being cocked.

In the following part of this cycle the lower part of the hand 35 will pass the cylinder latch 37 allowing the latch 37 to return to its initial position and to engage with the cylinder 14 again fixing the latter.

Just before the sear notch 23*b* of the hammer 23 will be engaged by the main sear 25 said special projection of the trigger 38, which presses the hammer strut 30, will slip out from under the hammer strut 30. As a result the hammer 23 under the action of the main spring 49 will fly forward and hit the firing pin 43 which in its turn will fire a cartridge. The cartridge shell being under the action of recoil force will move backwards pushing counter-clockwise the cartridge locking shutter 41, which in its turn pushes backwards clockwise the hammer 23. But since the pin 28 is in the special recess 41*a* of the shutter 41 there is an engagement between the hammer 23 and the shutter 41. Because of this engagement the movement of the shutter 41 and the hammer 23 slows down very much until a force, acting on the pin 28, acts to overcome the temporary interference of pin 28 and squeezes the spring 29 such that the pin 28 gets out of the recess 41*a*. (A force of the engagement between the hammer 23 and the shutter 41 depends very much on the spring 29 and on configurations of the recess 41*a* and the pin 28. There is no engagement between the hammer 23 and the shutter 41 if the latter is not under the action of the recoil force). Going on turning counter-clockwise the shutter 41 simultaneously turns clockwise the hammer 23. Simultaneously the hand 35 by its lower part turns the cylinder latch 37 counter-clockwise disengaging the latter with the cylinder 14. When moving further upwards the upper part of this hand 35 engages the ratchet gear 14*a* of the cylinder 14, thereby causing the cylinder 14 to rotate. Together with the cylinder 14 the fired cartridge shell is also rotated thus performing simultaneously longitudinal movement backwards and rotatory movement to the side. The construction of the hammer 23 and the shutter 41 excludes the movement of discharged gases and the recoiled cartridge shell backwards toward the user, because the movements of the shutter 41 and the hammer 23 are very slow in comparison with the movements of a bullet and discharged gases, which have time to leave the cylinder and the barrel before the fired cartridge shell, being under the action of inertia force, leaves the cylinder. Besides the hammer 23 and the shutter 41 are thick enough and even when the hammer is cocked it shades the user's body from the recoiled cartridge shell. After the cartridge shell leaves the cylinder 14 this shell hits the hammer 23 and is deflected by the latter to the side. When the fired cartridge shell left the gun, the shutter 41 under the action of the spring 44 will turn clockwise and it again will shut the opening 11*d* in the rear part of the frame 11 disposing behind the cylinder 14.

In the following part of this cycle the lower part of the hand 35 will pass the cylinder latch 37 allowing the latter to return to its initial position and to engage with the cylinder 14 again fixing the latter.

Figure 2:
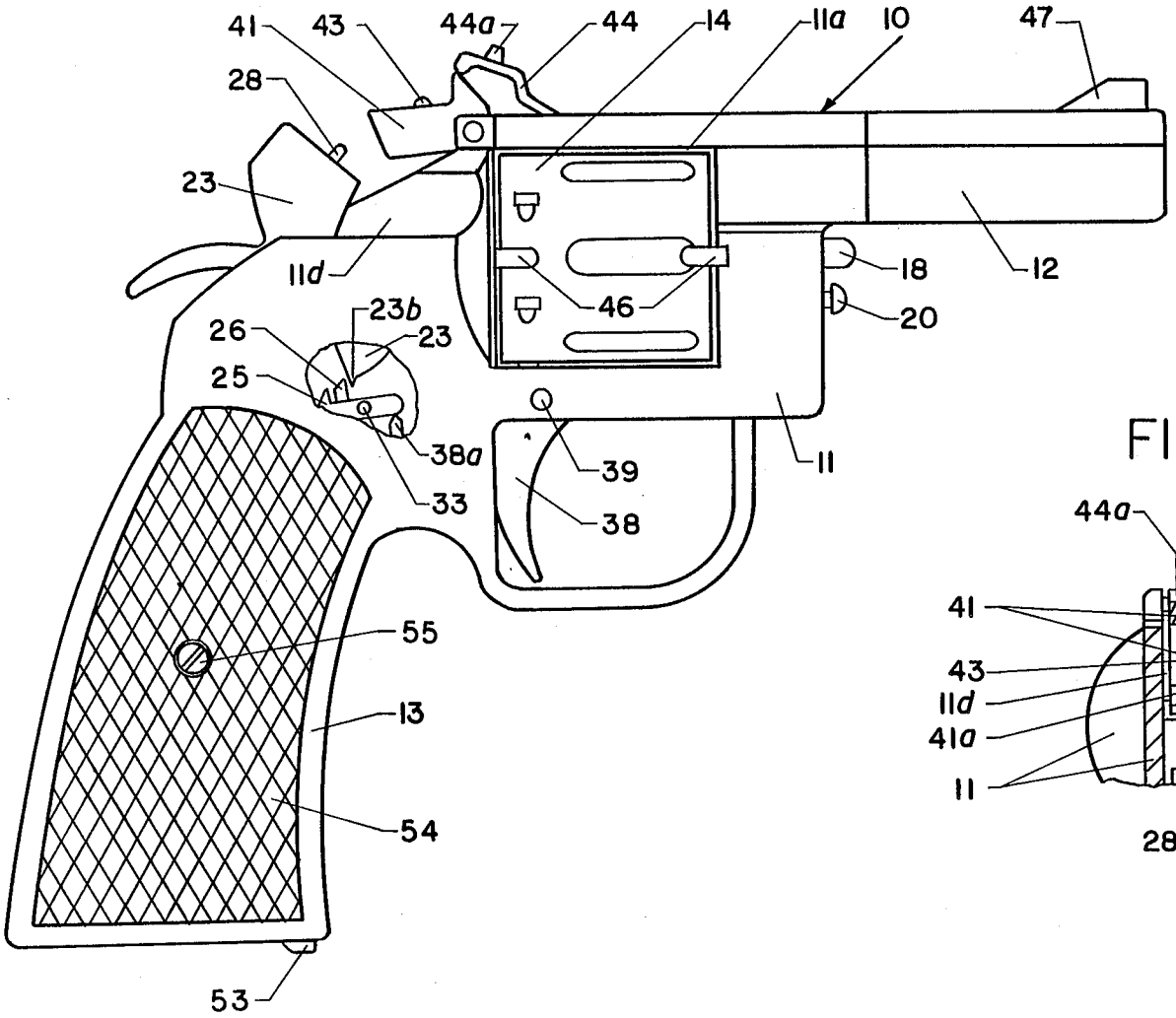
FIG. 2 is a side view of the gun of FIG. 1 immediately after a shot, and with certain parts broken away for explanatory purposes and better understanding of parts shown.
Figure 4:
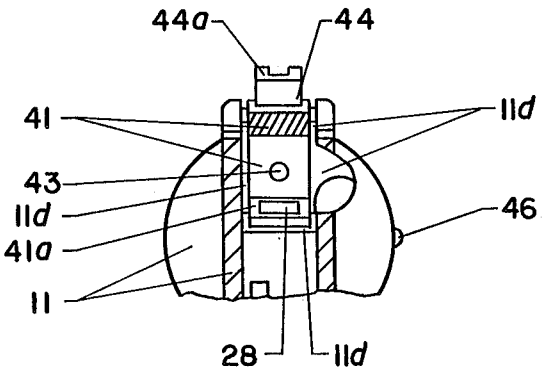
FIG. 4 is a fragmentary sectional view along line 2—2 of FIG. 1.

The hammer 23 will turn clockwise until its sear notch 23*b* is engaged by the auxiliary sear 26 which is pressed to the surface of the hammer 23 since the trigger 38 is turned counter-clockwise and this auxiliary sear 26 is moved upwards (see FIG. 2).

To make the next shot the trigger 38 has to be released. Then under the action of the trigger spring 40 the trigger 38 will turn clockwise around the pivot pin 39 moving downwards the auxiliary sear 26 which in its turn will disengage the sear notch 23*b* of the hammer 23. Then under the action of the main spring 49 the hammer 23 will turn counter-clockwise a little until the sear notch 23*b* of the hammer 23 will be engaged by the main sear 25.

Now to fire the next cartridge it is necessary to pull the trigger 38 backwards again. And again the trigger 38 will turn counter-clockwise around the pivot pin 39 but the trigger 38 will not turn the hammer strut 30 upwards because the hammer 23 has been already cocked and said strut 30 is up.

Turning upwards the trigger 38 will press the auxiliary sear 26 located on it to the surface of the hammer 23 and after this the main sear pushing projection 38*a* of the trigger 38 will contact and press the main sear 25 turning it clockwise and thus disengaging said sear 25 with the sear notch 23*b* of the hammer 23. As a result the hammer 23 under the action of the main spring 49 will fly forward and hit the firing pin 43 which in its turn will fire a cartridge.

The rest of the cartridges in the cylinder 14 may be fired in the same manner.

After all the cartridges in the cylinder 14 are fired, this cylinder 14 may be replaced by a spare one 14*s*. For this the latch 20 has to be pressed downwards. Then this latch 20 releases the cylinder locking rod 18, which is pressed by the rod 16 being under the action of the spring 17. As a result the cylinder locking rod 18 and the rod 16 move to the left and the rod 16 gets out of the recess 11*e* of the frame structure 11 and the cylinder locking rod 18 gets out of the opening 15*a* in the plug 15 and nothing holds the cylinder 14 in the recess 11*a* of the frame structure 11. Now the cylinder 14 may be pulled out of the recess 11*a*.

After this the spring-catch 53 has to be pressed to the left and the cover 52 may be opened and the spare cylinder 14*s* may be pulled out of the recess 51. The used cylinder 14 is pushed in the recess 51 and the cover 52 closes the recess 51. After this the spare cylinder 14*s* is being pushed into the recess 11*a* of the frame structure 11 until it contacts the cylinder detents 46. Then the cylinder locking rod 18 has to be pushed to the right until it will be locked by the latch 20. Now the revolver is ready to repeat the cycle from the beginning.

But if the hammer 23 remained in the cocked position after the preceding shot and if the cylinder latch 37 has not entered in one of the special recesses on the external surface of the cylinder, then said latch is turned a little counter-clockwise and its rear end will be engaged by the tooth 23*c* of the hammer 23, thus preventing rotation of the hammer 23 counter-clockwise after the sear notch 23*b* of the hammer 23 will be disengaged with the main sear 25 and the next shot will be blocked.

To avoid this it is necessary to pull trigger 38 fully backwards before the space cylinder 14*s* will be pushed into the recess 11*a* of the frame structure 11.

Figure 5:
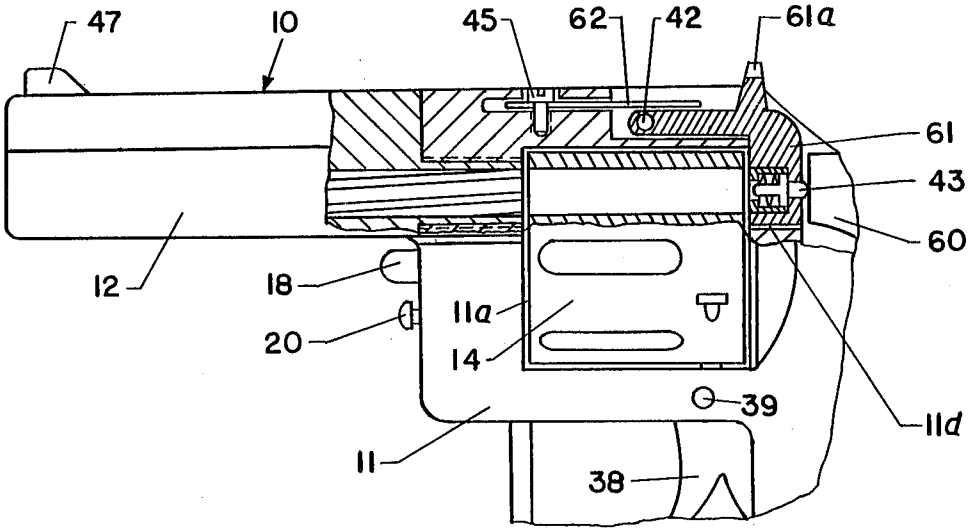
FIG. 5 is a fragmentary view, partly in section, of the gun showing another variation of cartridge locking system.

Referring now to FIG. 5 wherein is best shown the second modification of the cartridge locking shutter.

The gun in FIG. 5 has a few parts which differ from corresponding parts in the gun in FIGS. 1–4. The cartridge locking shutter 61 in FIG. 5 has another configuration than the cartridge locking shutter 41 in FIGS. 1–4, the hammer 60 in FIG. 5 has no recess with pin 28 and spring 29 located in it comparatively with the hammer 23 in FIGS. 1–4 and the cartridge locking shutter spring 62 in FIG. 5 has also another configuation in comparison with the spring 44 in FIGS. 1–4.

The rear sight 61*a* in FIG. 5 is located on the cartridge locking shutter 61 but not on a cartridge locking shutter spring as it is in FIGS. 1–4.

The rest of the part in FIG. 5 is the same as it is in FIGS. 1–4 and performs the very same functions.

Because cartridge locking shutter 61 in FIG. 5 has right-angle shape and the pivot pin 42 is located in the left end of the horizontal component (arm) of the shutter 61 and a cartridge shell being under the action of recoil force presses the vertical component (arm) of the shutter 61, a force resisting rotation of the shutter 61 basically depends on dimensions of said horizontal and vertical arms of the shutter 61. The length of said vertical arm may be changed very little, in return the length of said horizontal arm may be changed very much and thus selecting (changing) the length of said horizontal arm of the shutter 61 and the force of the spring 62 it is very easy to get a cartridge locking system with a very smooth action.

Although but a few variations of the present invention have been illustrated and described, it will be apparent to those skilled in the art that various changes and modifications may be made therein without departing from the spirit of the invention or from the scope of the appended claims.

What is claimed is:

1. In a revolver having a frame, a handle, a barrel extending forwardly of the frame, a trigger, a cartridge firing hammer, an indexible and changeable cartridge cylinder located in a recess of the frame, said cylinder having a first and a second end and an axis of symmetry, means movably fastening said cylinder in said recess of the frame, the improvement comprising:

(a) the changeable cartridge cylinder having an elongated cylinder chamber which has an axis of symmetry coinciding with the axis of symmetry of the cartridge cylinder, said chamber shut from the front and from the rear by two end walls at least one of which is detachable, each of said walls having a through bore with a diameter smaller than the diameter of said cylindrical chamber and having an axis of symmetry coinciding with the axis of symmetry of said cylindrical chamber of the cylinder, (b) a displaceable member having a first and a second end and a flange and disposed within said cylindrical chamber and said two bores, said displaceable member having a length at least approximately equal to the length of the cylinder, (c) biasing means interposed between the displaceable member flange and one of said end walls of the cylindrical chamber to urge the displaceable member toward an initial position when the displaceable member is not under the action of said cylinder fastening means, the frame characterized in that:

(1) it has at least one cavity in which is disposed said cylinder fastening means that is adjacent the first end of the cylinder, (2) it has a hole adjacent the second end of the cylinder to receive the second end of the displaceable member when the displaceable member is pressed by the cylinder fastening means, said cylinder fastening means consisting of:

(1) pushing means having an end which is located adjacent one of said bores in the end walls of said cylinder chamber of the cylinder, to be pushed into said bore, to fasten the cylinder in said recess of the frame, (2) said end of the pushing means entering into the bore in the end wall of the cylindrical chamber and pressing the first end of the displaceable member thereby pushing the second end of the displaceable member into said hole in the frame when the cylinder is fastened in said recess of the frame.

2. A revolver according to claim 1 further including a spring loaded latch locking said pushing means in the position in which said end of the pushing means is in the bore in the end wall of the cylindrical chamber of the cylinder.

3. A revolver as claimed in claim 1 further including at least one auxiliary cylinder detent located on at least one lateral side of said frame and positioned opposite to a lateral side of said cylinder recess of the frame at a determined distance from the axis of symmetry of the cylinder when the latter is in the working position inside of said recess of the frame, said determined distance at least approximately equal to a radius of the cylinder, said detent disposed against a lateral cylindrical surface of the cylinder to stop movement of the cylinder through said recess in the revolver frame as the cylinder reaches its working position during reloading of the gun for the purpose of rapid insertion of the cylinder into said recess of the frame.

4. A revolver as claimed in claim 3 in which said auxiliary cylinder detent is immovable.

* * * * *